US005616107A

United States Patent [19]

Simonson

[11] Patent Number: 5,616,107

[45] Date of Patent: Apr. 1, 1997

[54] METHOD AND APPARATUS FOR LEG PRESS EXERCISE WITH COUNTERBALANCE

[75] Inventor: Roy Simonson, Colorado Springs, Colo.

[73] Assignee: Cybex International, Inc., Ronkonkoma, N.Y.

[21] Appl. No.: 401,203

[22] Filed: Mar. 9, 1995

Related U.S. Application Data

[63] Continuation-in-part of Ser. No. 396,670, Mar. 1, 1995.

[51] Int. Cl.[6] ..... A63B 21/062; A63B 23/04

[52] U.S. Cl. ..... 482/97; 482/100; 482/134; 482/137; 482/142; 482/146; 482/908

[58] Field of Search ..... 482/52, 80, 92–94, 482/97–99, 100, 133, 135, 136, 137, 101, 134, 138; 601/34, 35

[56] References Cited

U.S. PATENT DOCUMENTS

D. 321,389 11/1991 Jones .
D. 321,390 11/1991 Jones .
D. 321,391 11/1991 Jones .

(List continued on next page.)

FOREIGN PATENT DOCUMENTS

WO80/00308 3/1980 WIPO .
WO81/03126 11/1981 WIPO .

OTHER PUBLICATIONS

Loredan Biomedical, Inc., "Lido Loredan, A New Vision Of Strength Training", Brochure, pp. 1, 14, 15 & 17, 1990.
CYBEX Div. Of Lumex, Inc., "CYBEX Strength Systems Modular," Brochure, p. 6, Jun. 1994.
Nautilus Sports/Medical Industries, Inc., "Nautilus Instruction Manual", Brochure, pp. 8 & 14, 1980.
CYBEX Div. Of Lumex, Inc., "Eagle Fitness Systems By CYBEX," Brochure, pp. 25–27.
CYBEX Div. Of Lumex, Inc., "Eagle Performance Systems, The New Standard Of Excellence," Brochure, pp. 9, 10 & 13.
CYBEX Div. Of Lumex, Inc., "CYBEX Strength Systems, A Body Of Work", Brochure, 1989/1990.
CYBEX Div. Of Lumex, Inc., "CYBEX Strength Systems, A Body Of Work" (VR), Brochure, 1989/1990.
CYBEX Div. Of Lumex, Inc., "CYBEX Strength Systems", Service And Parts Manual, p. 29, 1992.
CYBEX Div. Of Lumex, Inc., "CYBEX Strength Systems", Brochure, pp. IV–10, V–14 & VII–27, 1993.
CYBEX Div. Of Lumex, Inc., "CYBEX Strength Systems Owner's Manual", pp. 8 & 10–12, Brochure.
CYBEX Div. Of Lumex, Inc., "CYBEX Extremity Systems, The CYBEX 6000 Extremity System", Brochure, 1991.
CYBEX Div. Of Lumex, Inc., "Fastex Exclusively From CYBEX", Brochure, Jun. 1994.
CYBEX DIV. Of Lumex, Inc., "Medical Strength Systems", Brochure, p. 6, 1993.
CYBEX Div. Of Lumex, Inc., "CYBEX Testing And Rehabilitation Systems", Brochure, 1993.

(List continued on next page.)

*Primary Examiner*—Richard J. Apley
*Assistant Examiner*—Victor K. Hwang

[57] ABSTRACT

An apparatus and a method for performing a leg press exercise with counterbalance are disclosed. A user support, such as seat and a backrest, is mounted to a frame. A swing, such as a four-bar linkage, is mounted to the frame distal to the user support. A footplate is mounted to the four-bar linkage. An arm with a counterweight is pivotally connected to the frame. A beam is rotatably mounted to the four-bar linkage and the arm. The footplate is adjusted relative to the seat by variation of the length of a connection between a pulley weight system and the four-bar linkage. The footplate rotates arcuately with respect to the frame during adjustment to accommodate users of various stature. The position of the counterweight changes during footplate adjustment in order to compensate for the changing effect of gravity on the footplate and the swing.

25 Claims, 7 Drawing Sheets

U.S. PATENT DOCUMENTS

| | | |
|---|---|---|
| D. 324,710 | 3/1992 | Habing . |
| 1,703,104 | 2/1929 | Hassler . |
| 2,253,996 | 8/1941 | Bechman . |
| 3,707,285 | 12/1972 | Martin . |
| 3,734,495 | 5/1973 | Nist et al. . |
| 3,759,511 | 9/1973 | Zinkin et al. . |
| 3,858,873 | 1/1975 | Jones . |
| 3,998,454 | 12/1976 | Jones . |
| 4,149,714 | 4/1979 | Lambert, Jr. . |
| 4,169,589 | 10/1979 | McArthur . |
| 4,200,279 | 4/1980 | Lambert, Jr. . |
| 4,227,689 | 10/1980 | Keiser . |
| 4,235,437 | 11/1980 | Ruis et al. . |
| 4,298,893 | 11/1981 | Holmes . |
| 4,314,697 | 2/1982 | Brumfield et al. . |
| 4,341,380 | 7/1982 | Sauder . |
| 4,357,010 | 11/1982 | Telle . |
| 4,358,105 | 11/1982 | Sweeney, Jr. . |
| 4,462,252 | 7/1984 | Smidt et al. . |
| 4,465,274 | 8/1984 | Davenport . |
| 4,470,597 | 9/1984 | McFee . |
| 4,482,152 | 11/1984 | Wolff . |
| 4,500,089 | 2/1985 | Jones . |
| 4,502,681 | 3/1985 | Blomqvist . |
| 4,505,475 | 3/1985 | Olschansky et al. . |
| 4,511,137 | 4/1985 | Jones . |
| 4,555,108 | 11/1985 | Monteiro . |
| 4,645,197 | 2/1987 | McFee . |
| 4,684,126 | 8/1987 | Dalebout et al. . |
| 4,807,877 | 2/1989 | Buxton . |
| 4,834,365 | 5/1989 | Jones . |
| 4,836,536 | 6/1989 | Jones . |
| 4,842,271 | 6/1989 | Vinciguerra . |
| 4,915,378 | 4/1990 | Abrahamian et al. . |
| 5,000,446 | 3/1991 | Sarno . |
| 5,058,888 | 10/1991 | Walker et al. . |
| 5,066,003 | 11/1991 | Jones . |
| 5,066,004 | 11/1991 | Jones . |
| 5,078,152 | 1/1992 | Bond et al. . |
| 5,106,080 | 4/1992 | Jones . |
| 5,106,081 | 4/1992 | Webb . |
| 5,108,095 | 4/1992 | Nicols . |
| 5,152,733 | 10/1992 | Farenholtz et al. . |
| 5,171,200 | 12/1992 | Jones . |
| 5,180,354 | 1/1993 | Jones . |
| 5,209,715 | 5/1993 | Walker et al. . |
| 5,244,441 | 9/1993 | Dempster et al. . |
| 5,254,067 | 10/1993 | Habing et al. . |
| 5,263,914 | 11/1993 | Simonson et al. . |
| 5,273,508 | 12/1993 | Jones . |
| 5,314,390 | 5/1994 | Westing et al. . |
| 5,366,432 | 11/1994 | Habing et al. . |

OTHER PUBLICATIONS

CYBEX Div. Of Lumex, Inc., "CYBEX Strength Systems", Brochure, 1993.

Nautilus Sports/Medical Industries, Inc., "Leverage Machines By Nautilus Instruction Manual", Brochure, p. 5.

Nautilus Sports/Medical Industries, Inc., "Machine Operating Manual: Instructions For Use, Maintenance Tips, Warranties, Parts", Brochure, p. 12.

Nautilus Sports/Medical Industries, Inc., "Nautilus Midwest New Products", Brochure.

Atlantic Fitness Products, "Specialists In Physical Fitness And Health Equipment", Brochure, 1985.

Bodymasters, "Expect The Best", Brochure.

Bodymasters, Brochure, p. 28.

Hammer Strength, Hammer Strength Picture Price List, Oct. 1994.

Lamb Bodybuilding Machines, "Four–Bar Heavy–Duty Plate–Loaded Variable–Resistance Bodybuilding Machines", Brochure, pp. 1 & 2.

The Ariel Computerized Exercise System: "CES 5000 ARM–LEG", Brochure.

Muscle Dynamics, "Maxicam By Muscle Dynamics", Product Listing, Brochure.

Universal Gym Equipment, Inc., "Universal Conditioning Machines And Free Weights", Brochure.

Delorme, Captain Thomas L., "Restoration Of Muscle Power By Heavy–Resistance Exercises", The Journal Of Bone And Joint Surgery, vol. XXVII at 645, 669 (1945).

Athletic Journal, vol. 59, No. 2, Oct. 1978, Advertisements.

METHOD AND APPARATUS FOR LEG PRESS EXERCISE WITH COUNTERBALANCE

This application is a continuation-in-part of pending application Ser. No. 08/396,670 filed on Mar. 1, 1995 and assigned to the assignee of the present application, entitled, "Rear Deltoid and Rowing Exercise Machine and Method of Exercising," Roy Simonson, inventor.

FIELD OF THE INVENTION

The present invention relates to the field of exercise and physical rehabilitation equipment, in particular, to an apparatus for exercising the legs and lower torso having a counterbalance.

BACKGROUND OF THE INVENTION

It is often necessary or desirable for a person to exercise a particular muscle or group of muscles. For example, when a muscle is damaged, such as through injury or surgery, it is important to exercise the muscle to prevent atrophy and to strengthen the muscle for normal use. Further, people exercise healthy muscles to increase strength and to maintain an active and healthy lifestyle, as well as to improve their appearance. Various routines have been developed to exercise different muscle groups by forcing the muscles to contract and extend under a load, such as by moving a free weight against the force of gravity or by moving a pad or a sled whose movement is resisted by an exercise machine.

One exercise that has been developed to exercise the leg muscles is known as the leg press. A typical leg press exercise machine includes a footplate that moves relative to a seat. The user sits in the seat and places her feet on the footplate such that her legs are initially in a contracted or bent position. As the user extends her legs from the contracted position, the footplate is pushed away from the seat. The footplate typically is coupled to a resistance means that provides a reactive force against the force applied by the user.

Currently, leg press exercise machines having features similar to those disclosed in Jones, U.S. Pat. No. 5,106,080, and Simonson et al., U.S. Pat. No. 5,263,914, include an adjustable seat for accommodating users having different body sizes and leg lengths. The position of the seat relative to the footplate is adjusted prior to the commencement of exercise such that the user can exercise over a full range of motion. Alternatively, the footplate may be disposed at various initial positions with respect to a fixed seat.

Counterbalancing mechanisms, such as that disclosed in U.S. Pat. No. 3,858,873, are included in exercise machines in an attempt to overcome the inherent friction, gravity or weight resistance in operating the machine. Such a counterbalance, if implemented properly, would enable a user to exercise or train using zero or very small resistance loads. Further, the weight indicated on the resistance mechanism, such as a weight stack, would reflect accurately the weight resistance overcome by the user.

Leg press machines, however, do not provide an effective counterbalance over the full range of motion, particularly in view of the different initial positions for exercisers of varying stature. As the footplate is moved through the full range of motion, the position of the counterbalance mechanism and its counterbalance effect may change. This may require that the user exert more or less force than indicated on the resistance means. Further, traditional leg press machines allow adjustment for users of varying stature by sliding the seat toward the footplate. This may cause the orientation of the footplate with respect to the seat to change such that the user's foot is disposed in an awkward position during exercise. In particular, the footplate may be too high above the seat for short limbed users and too low for long limbed users. Further, the footplate may be tilted upward or downward too far such that a user will need to tilt her foot with respect to her foreleg to permit the foot to lie flat on the footplate. Consequently, the extension force will operate through the foot at an angle, rather than orthogonal to the bottom of the foot.

SUMMARY OF THE INVENTION

It is therefore an object of the present invention to provide a method and apparatus for performing a leg press in which the inherent resistance of the leg press machine is counterbalanced over the full range of motion.

It is another object of the present invention to provide a method and apparatus for providing a leg press exercise in which the initial position may be adjusted while the footplate is maintained in an effective exercise orientation for users of varying stature.

It is another object of the present invention to provide an apparatus for performing a leg press exercise in which a user can easily displace a footplate to a comfortable initial position.

These and other objects of the invention will be apparent from the following summary and detailed description of the invention.

In one embodiment of the present invention, the leg press machine comprises a four-bar linkage including a frame, a push bar, a link and a mount, wherein the push bar and the link both are pivotally connected to the mount and the frame. A footplate is rigidly coupled to the mount. A counterbalance arm is rotationally mounted to the frame distal to the four-bar linkage. A beam is pivotally connected to the arm and the push bar. A telescoping rod with a pin/detent locking mechanism connects the push bar to a pulley weight system. The user may selectively engage the pin/detent locking mechanism, thereby changing the length of the telescoping rod and causing the footplate to be displaced closer to or further from a user support. The counterbalance arm, which is engaged to the four-bar linkage, is rotated a corresponding amount to counteract the displacement of the footplate, such that the net force on the footplate due to the inherent resistance of the machine is substantially zero. The arcuate movement of the footplate as controlled by the four-bar linkage permits the user to place the soles of her feet flat on the surface of the footplate while maintaining her foreleg substantially perpendicular to the footplate.

Additional features and advantages of the present invention will become readily apparent to those of ordinary skill in the art by reference to the following detailed description and accompanying drawings.

DETAILED DESCRIPTION OF THE DRAWINGS

Figure 1:
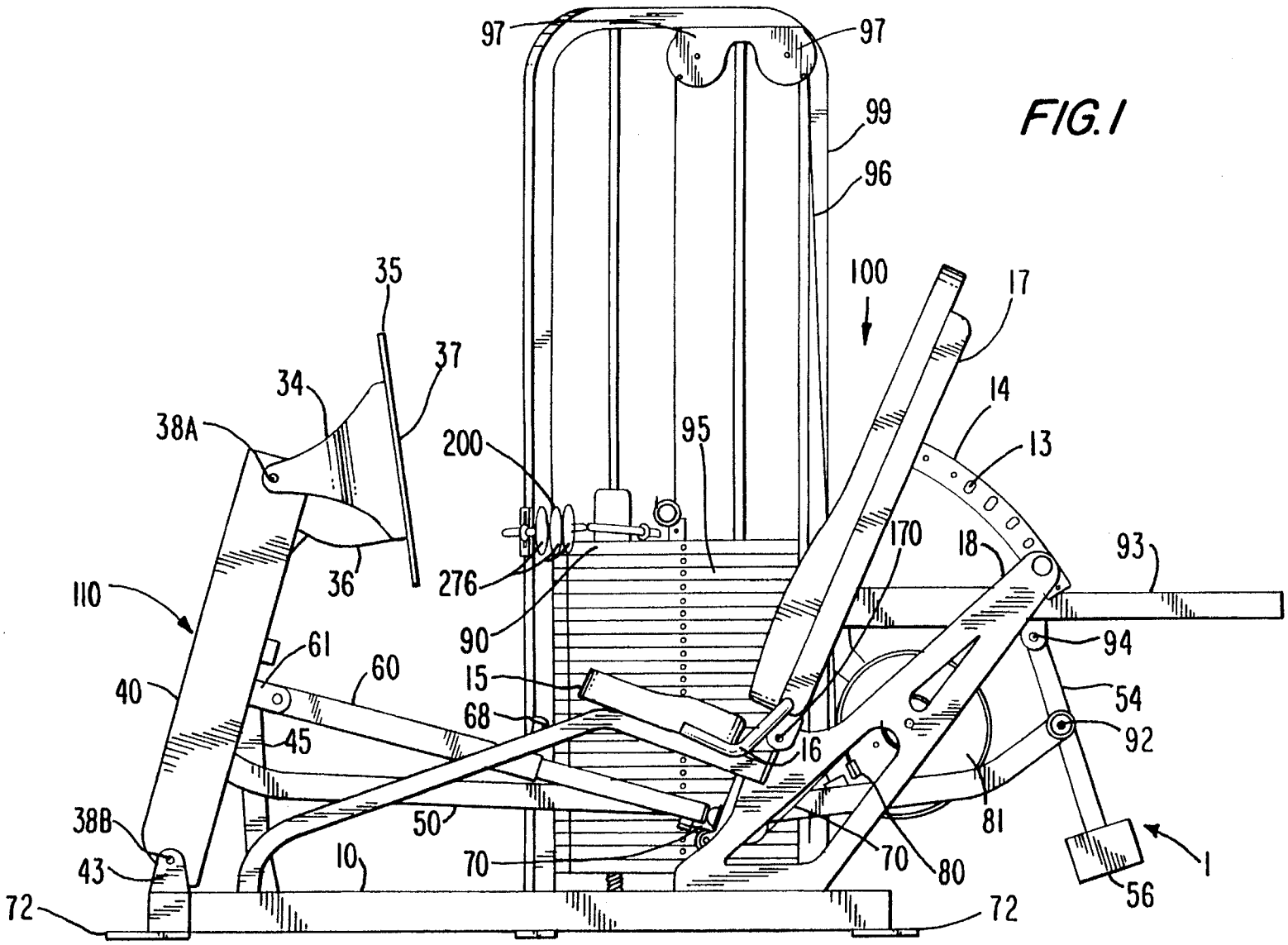
FIG. 1 is an elevational view from the left side of a leg press machine of an embodiment of the present invention.

FIG. 1 is a side view of a leg press machine 1 of an embodiment of this invention viewed from the left side. A seat 15 is rigidly mounted to a frame 10. The frame may be constructed of 1½×3 inch, 11 gage rectangular mild steel tubing. The seat may be adjustable such that the height, angle or position of the seat on the frame can be varied for a particular user. Handles 16 (only one shown) are rigidly mounted to the frame 10 on each side of the seat 15. Alternatively, the handles 16 may be adjustable to increase user comfort.

A backrest 17 is rotatably mounted to the frame 10 about a backrest pivot 170. An arcuate backrest support 14 is rigidly fixed at one end to the backrest 17. The backrest support 14 includes a plurality of apertures 13 which provide for selective engagement to a frame bar 18. The frame bar 18 may be in the shape of a truss rigidly attached to the frame 10. One of the apertures of the backrest support 14 may be engaged to the frame bar 18 using conventional techniques, such as a spring-biased pin that selectively engages the aperture. The backrest support 14 provides that the backrest 17 may be articulated to various orientations with respect to the seat 15. The seat 15 and the backrest 17 form a user support 100. Anchors 72 are disposed at the bottom of the frame 10 and are adapted to mount the machine 1 to the floor of a gym, if so desired.

A footplate 35 is pivotally mounted to the frame by a swing 110. As discussed more fully below, the swing 110 may be a four-bar linkage including a push bar 40 pivotally connected to the frame 10 and the footplate 35. A resistance mechanism is operably engaged to the swing 110 to provide resistance to the displacement of the footplate 35. As discussed more fully below, the resistance mechanism may include a weight stack 95 with an incremental weight stack 200 attached to the swing 110 by belts 96 via a cam-pulley arrangement. Preferably, weight stack pulleys 97 are aligned with the belts 96 so that the belts 96 lie flat on the pulleys 97. As described more fully below in connection with FIGS. 5–7, the pulleys 97 may be self-aligning pulleys such that the belts 96 and the pulleys 97 need not be perfectly aligned during manufacture and assembly of the machine 1. Other resistance mechanisms known in the art, including friction, pneumatic, hydraulic, electric or magnetic resistance, flywheels, springs, or any combination of these, may be used and still practice the invention.

Figure 2:
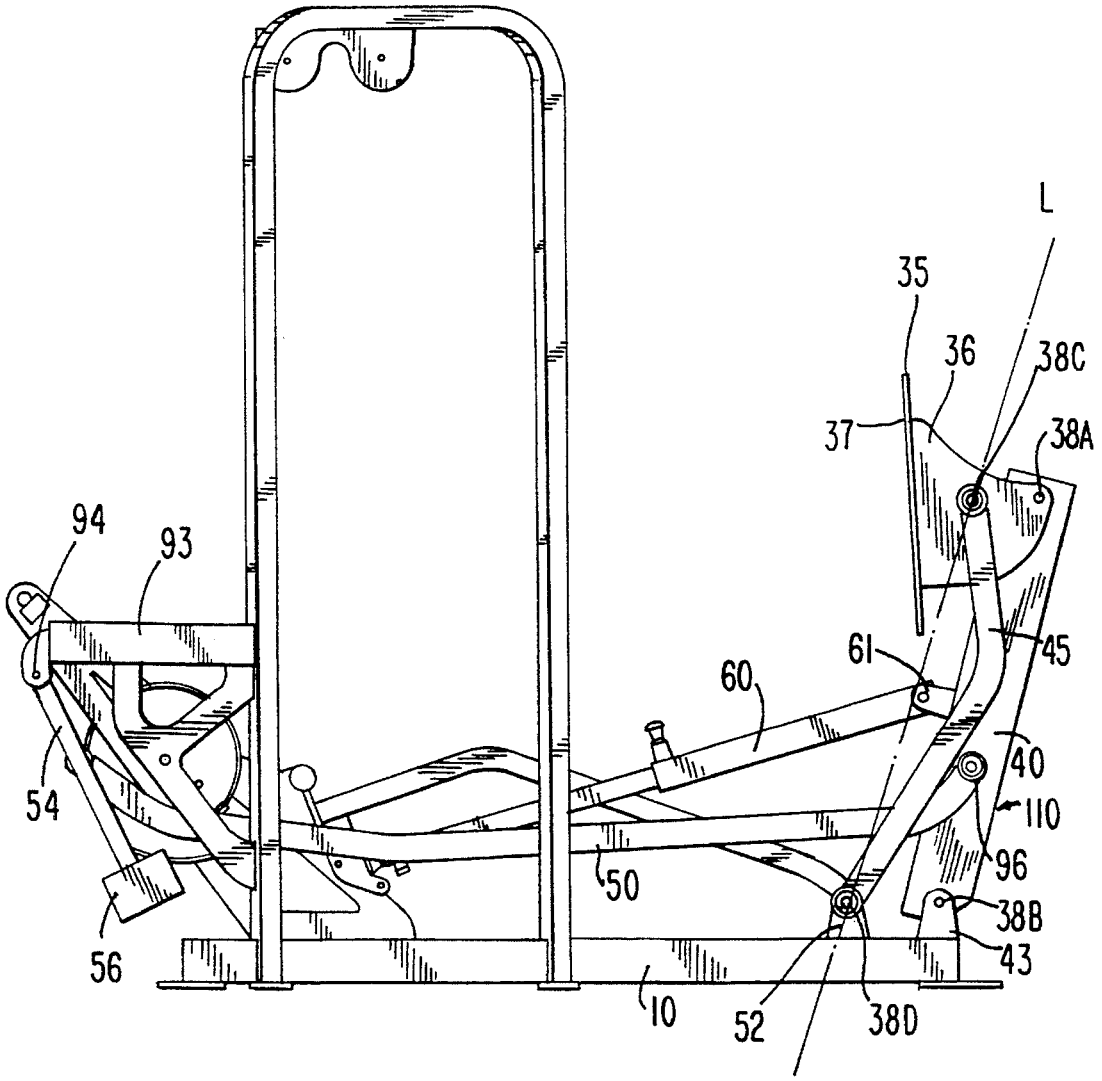
FIG. 2 is an elevational view from the right side of the machine of FIG. 1 with the footplate position displaced away from the seat.
Figure 3:
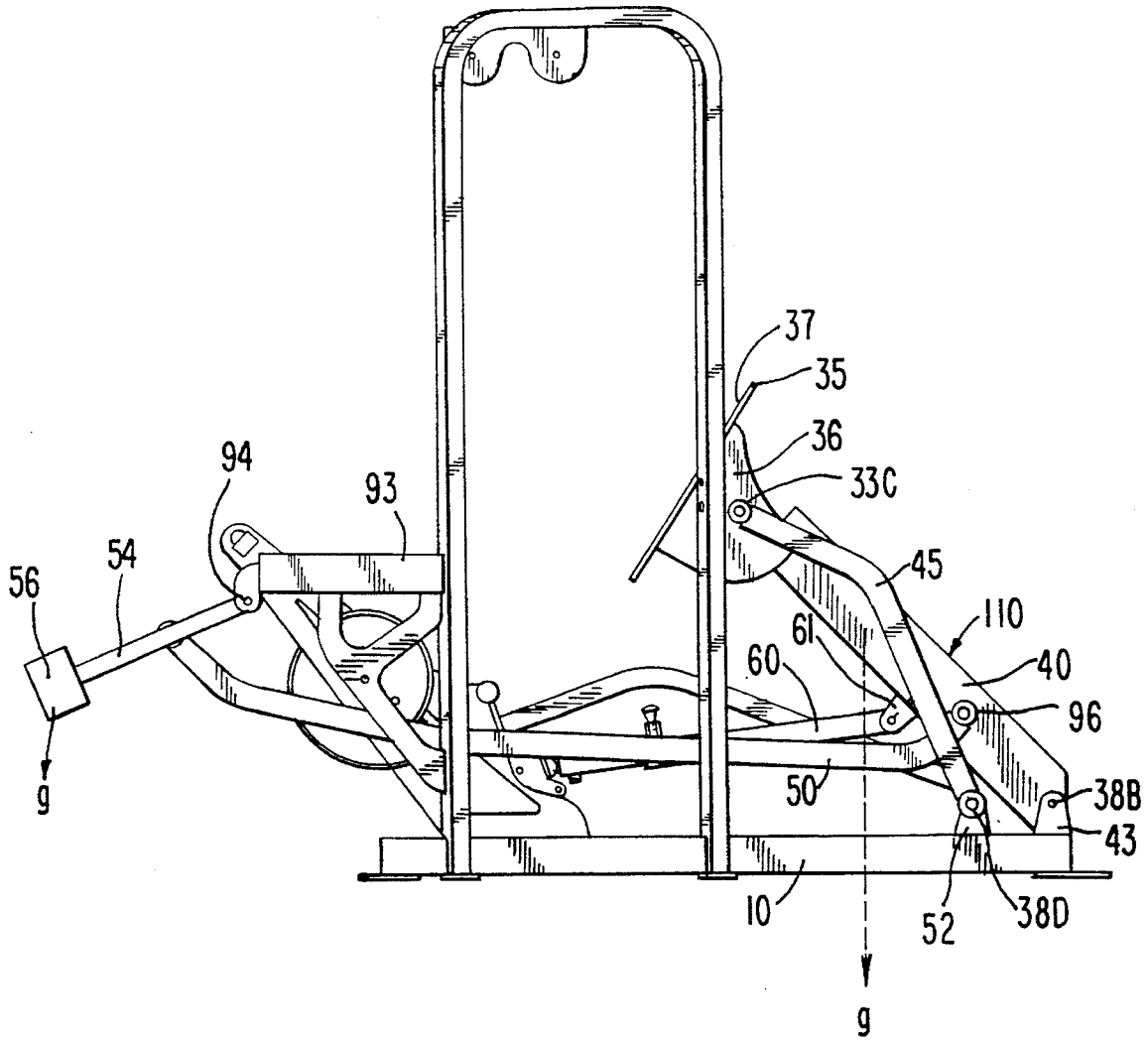
FIG. 3 is another elevational view from the right side of the machine of FIG. 1 with the footplate position displaced proximate to the seat.

FIGS. 2 and 3 are right side elevational views of the apparatus of FIG. 1 in different initial positions with the weight stack 95 and the user support 100 removed for clarity. As shown in FIG. 2, the footplate 35 is positioned for a user with longer limbs, i.e., the footplate 35 is disposed further from the user support 100. As shown in FIG. 3, the footplate 35 is positioned for a user with shorter limbs, i.e., the footplate 35 is disposed nearer the user support 100.

The footplate 35 is attached to footplate mounts 34 (shown in FIG. 1) and 36 (shown in FIGS. 2 and 3), such as by welding. The footplate 35 may have a roughened surface 37 which faces the user support 100, or a non-skid material may be applied to the surface 37 to prevent a user's feet from sliding along the footplate 35 during operation. The mounts 34 and 36 are rotatably mounted, such as by sealed bearings, to one end of the push bar 40 at pivot 38A. The sealed bearings used with this machine may be metric bearing, model #87503, manufactured by Fafnir, an equivalent or other such bearing. The other end of the push bar 40 is rotatably mounted to flanges 43 on the frame 10 at pivot 38B. A link 45 is pivotally mounted to the mount 36 at pivot 38C and pivotally mounted to a flange 52 at pivot 38D. The link 45 is bent in at the center to reduce the envelope occupied by the four-bar linkage. The flange 52 is rigidly mounted to the frame 10. Again, sealed bearings may suitably be used to permit the link 45 to rotate with respect to the frame.

The frame 10, the push bar 40, the link 45 and the mounts 34 and 36 create a four-bar linkage defined by the pivots 38A, 38B, 38C and 38D. The distances between the pivots 38A and 38B on the push bar 40 and the pivots 38C and 38D on the link 45 may be selected such that the footplate 35 is caused to rotate counterclockwise as viewed in FIGS. 2 and 3 as the footplate is displaced away from the user support 100 (compare FIGS. 2 and 3). This rotation of the footplate helps to maintain the user's foreleg in an orthogonal relationship to the footplate 45 during exercise. As currently preferred, the distance between the pivots 38A and 38B is 30 inches; the distance between the pivots 38B and 38D is 6.5 inches; the distance between the pivots 38D and 38C (along line L) is 30.5 inches; and the distance between the pivots 38C and 38A is 5.25 inches. Of course, other distances may be employed and still practice the invention.

A counterbalance arm 54 is pivotally mounted at a pivot 94 to a frame extension bar 93 which is rigidly mounted to the frame 10. A counterweight 56 is rigidly mounted to the arm 54 distal the pivot 94. It is to be understood, however, that the counterweight 56 need not be a separate component in the machine 1, and its effective weight may be incorporated into the arm 54 to implement the present inventive technique. A beam 50 is pivotally mounted to the push bar 40 and the counterbalance arm 54 by pivots 96 and 92, respectively. As discussed more fully below, the beam 50 operably engages the arm 54 and the counterweight 56 to the swing 110.

A telescoping rod 60 with a pin/detent locking mechanism 68 is pivotally attached at one end to the push bar 40 by a tab 61 disposed below the footplate 35. The telescoping rod 60 is fixed at its other end to a footplate belt 70. The telescoping rod 60 provides that the length of the connection between the belt 70 and the push bar 40 may be suitably varied through use of the pin/detent locking mechanism 68. It is to be understood, however, that the telescoping rod 60 with the pin/detent mechanism 68 may comprise any means for incrementally or decrementally adjusting and then temporarily fixing the length of a connection between the push bar 40 and the belt 70. Changing the length of the telescoping rod 60 permits the four-bar linkage to rotate freely, i.e., without lifting the weight stack 95, thereby permitting the footplate 35 to be displaced either toward or away from the user support 100 to a desired initial position. As discussed more fully below, the counterweight 56 provides a force through the beam 50 to counteract the force of gravity on the swing 110 and the footplate 35. Consequently, the footplate 35 can be easily moved to different initial positions despite the weight of the swing 110 and the footplate 35.

The footplate belt 70 is suitably threaded through a pulley weight system 80 and coupled to individual weight plates 90 of a weight plate apparatus 99 which includes the weight stack 95. The pulley weight system 80 may include an eccentric cam 81 having a profile selected to provide a balanced resistance over the full range of motion as is conventional in the art.

To operate the leg press machine 1 with counterbalance, the user adjusts the footplate 35 to an appropriate initial position. The user disengages pin/detent mechanism 68, permitting the rod 60 to telescope freely and disengaging the swing 110 from the weight stack 95. The user then positions the footplate 35 at the desired initial position and re-engages the pin/detent mechanism 68, effectively engaging the swing 110 to the weight stack 95. The user then selects the desired weight resistance by inserting a pin at an appropriate position in the weight stack 95, as is known in the art. To select a more precise resistance, the user may employ the incremental weight stack 200, discussed below.

The user places her feet on the footplate and presses the footplate away from the user support 100. Displacement of the footplate 35, either when selecting an initial position or during exercise, causes the swing 110 to rotate about the frame 10. The footplate 35 is directed in an arcuate path towards and away from the user support 100 by the swing 110. For a typical user, in the initial position, the footplate 35 is tilted up, since the user's legs are drawn into her chest (see FIG. 3). As the footplate 35 is moved away from the user support 100 and toward the end of the range of motion (either when adjusting the initial position or during the exercise stroke), the footplate 35 rotates about the pivot 38C to a position in which it is tilted slightly down (see FIG. 2). When the user's legs are fully extended, the feet are disposed above the buttocks, thus the downward tilt of the footplate 35 permits the user to keep her feet flat on the surface 37 of the footplate 35 while maintaining the foreleg substantially perpendicular to the footplate 35. Preferably, the lengths of the links of the four-bar linkage of the swing are selected such that the user's foreleg is maintained substantially perpendicular to the surface 37 of the footplate 35 during the entire exercise stroke.

As the swing 110 is pivoted away from the user support 100 during exercise, the rod 60 is also moved away from the user support 100. The rod 60 pulls on the footplate belt 70, causing the cam/pulley arrangement 80 to rotate. The rotating cam 81 pulls on the weight stack belt 96, which rides over the pulleys 97 and lifts the weight stack 95, as well as any incremental weights 276 which are operably coupled to the weight stack 95, as explained more fully below in connection with FIG. 4. As shown in FIGS. 1–3, the pulleys 97 are aligned with the belts 96 so that the belts 96 lie flat on the pulleys 97. The pulleys 97 may be replaced with self-aligning pulleys to better insure that the belts 96 are held in position, as explained below in connection with FIGS. 5–7.

The force of gravity operates on the swing 110 and the footplate 35 creating additional resistance to the exercise during the beginning of the pressing motion if the counterbalance mechanism is not utilized. Also, if the user is particularly long-legged, the force of gravity operates at the end of the pressing motion to counteract the resistance provided by the weight plates 90 if the counterbalance mechanism is not utilized. It will be observed that gravity also operates on the counterweight 56 to pull the counterweight 56 down. The movement of both the counterweight 56 and the swing 110 due to gravity is prevented by the engagement of the arm 54 to the swing 110 by the beam 50. Referring to FIG. 3, for example, the force of gravity on the counterweight 56 exerts force on the beam 50 to the right. The force of gravity on the swing 110 exerts force on the beam 50 to the left. As the footplate 37 is displaced during exercise such that the swing 110 approaches a vertical position, the effect of gravity causing rotation of the swing 110 is lessened. Correspondingly, the arm 54 approaches a vertical position so that the effect of gravity on the counterweight 56 causing rotation of the swing 110 is lessened. Preferably, the counterweight 56 is selected in view of the geometry such that the forces on the beam 50 cancel each other or "counterbalance."

As currently preferred, the counterweight 56 weighs 55 lbs; the length of the arm 54 is 16 inches; the distance from the pivot 94 to the pivot 92 is 7 inches; the weight of the four-bar linkage and the footplate 35 is 96 lbs; and the beam 50 is connected to the push bar 40 at a position 10.25 inches from the pivot 38B. If weight plates 90 are not connected to the footplate belt 70 (e.g., the pin/detent mechanism 68 is disengaged such as for adjustment of the initial position), the net load on the footplate 35 is, preferably, nominal or equal to zero despite the force of gravity.

Figure 4:
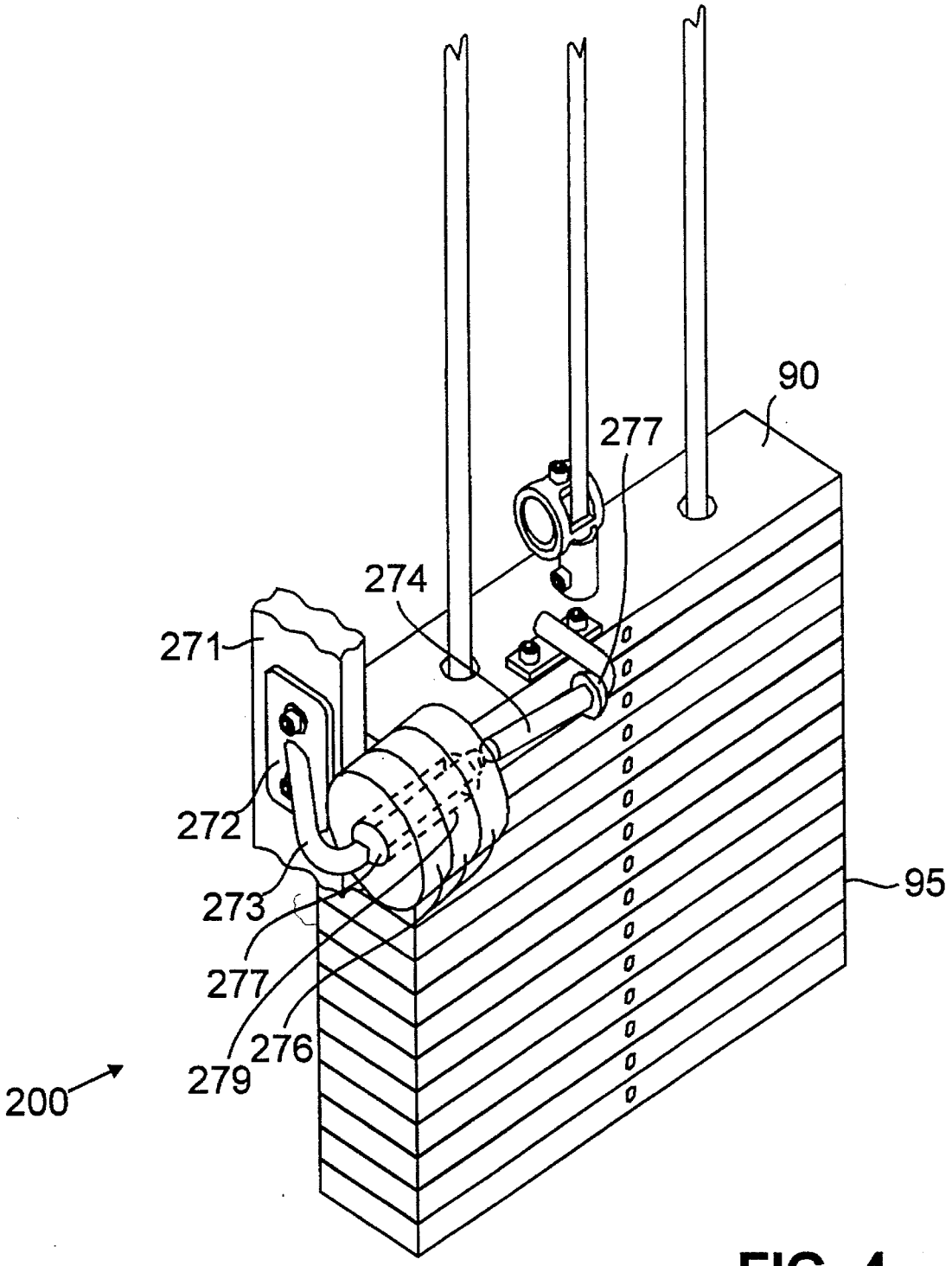
FIG. 4 is a perspective view of an incremental weight stack which may be utilized in accordance with the present invention with the machine in FIG. 1.

FIG. 4 is a perspective view of the incremental weight stack 200 for use with a selectorized exercise machine, such as the apparatus of FIG. 1. A brace 271 is rigidly mounted to the frame 10, such as by welding or bolting. A flange or storage finger 273 (shown partly in phantom) is rigidly mounted to a flange 272, which in turn is attached to the brace 271, such as by bolting. Slotted holes (not shown) may be provided in the flange 272 for height adjustment. The flange finger 273 extends proximate to the top weight plate 90. A stack or movement finger 274 is mounted to the top of the top weight plate 90. The incremental weights 276, having tracks such as axial bore 279 (shown in phantom) for receiving the fingers 273 and 274, are slidingly mounted on the flange finger 273. When the weight stack 95 is lowered (i.e., in the rest position), the tips of the frame finger 273 and the stack finger 274 are adjacent, almost touching. The incremental weights 276 can be moved from the flange finger 273 to the stack finger 274 as desired. The tips of the fingers 273 and 274 may be rounded to provide for a smooth transfer of the incremental weights 276. Washers 277 can be mounted to the fingers 273 and 274 to restrict the movement of the incremental weights 276 on the fingers 273 and 274. Preferably, both fingers 273 and 274 are slanted up toward the tips at approximately 5° from horizontal. This angle retains the incremental weights 276 on the respective fingers while permitting the weights 276 to easily slide from one finger to the other. When the user lifts the weight stack 95, she also must lift any incremental weights 276 on the stack finger 274.

The incremental weight stack 200 permits use of heavy plates on the main weight stack 95. For example, each plate 90 on the main stack may weigh 20 pounds. Each incremental weight 276 may be 5 pounds. If three incremental weights 276 are mounted to the flange finger 273, the user can select the appropriate resistance in five-pound increments by sliding the appropriate number of the weights 276 to the stack finger 274. This allows the user to finely adjust the resistance at any point throughout the weight stack 95. Further, the manufacturer will save costs in manufacturing and assembling an exercise machine with the incremental weight stack 200 due to the labor saved using a small number of plates.

Figure 5:
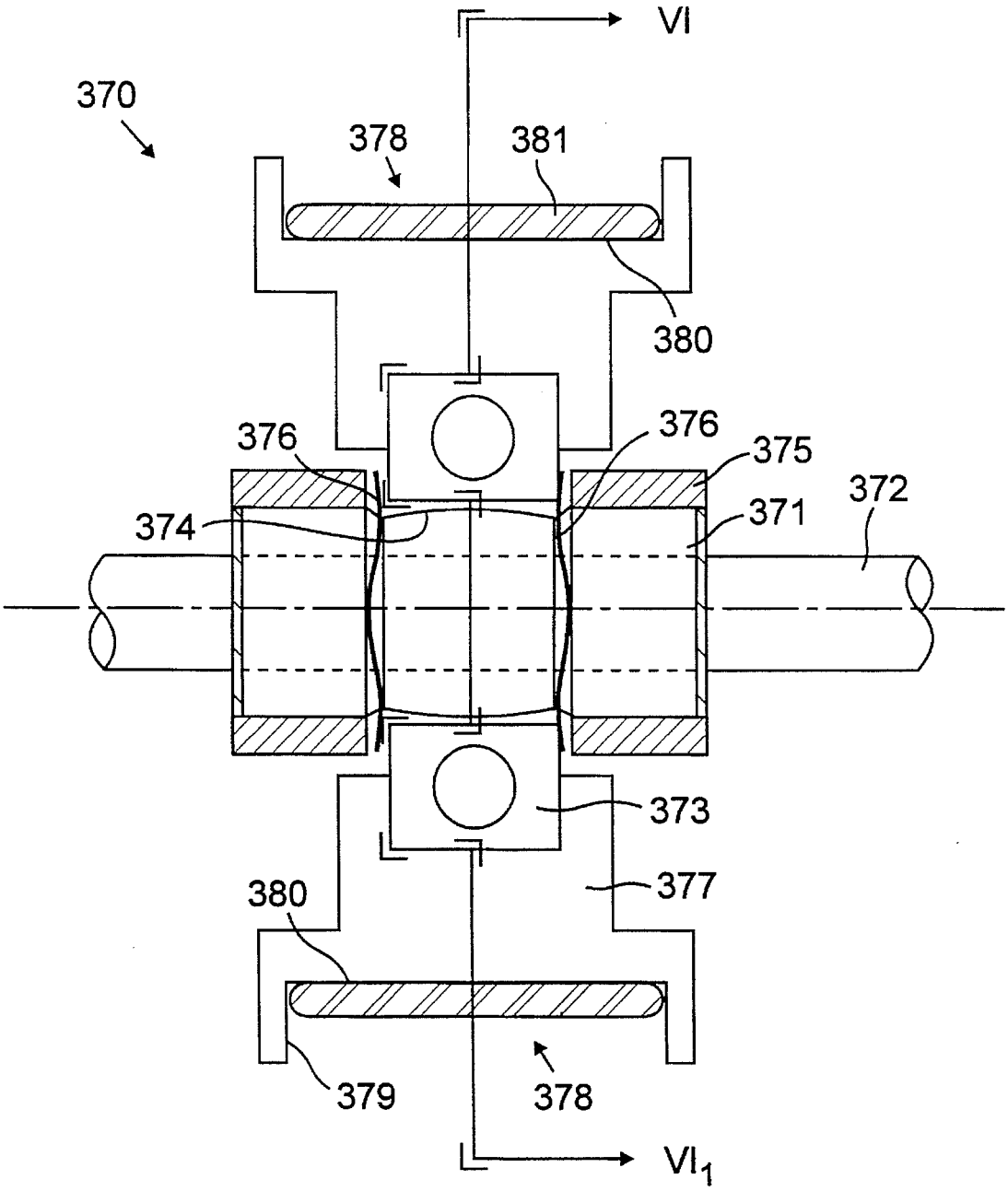
FIG. 5 is a cross sectional view of a self-aligning pulley which may be utilized in accordance with the present invention with the machine in FIG. 1.

FIG. 5 is a cross sectional view of a self-aligning pulley 370 for use with an exercise machine, such as the apparatus of FIG. 1. The pulley 370 is designed to align itself with a belt 381 when either the frame 10 or the belt 381 is not perfectly aligned. Such a self-aligning pulley may be substituted for the traditional pulley used as the weight stack pulley 97 in the apparatus shown in FIG. 1.

Figure 6:
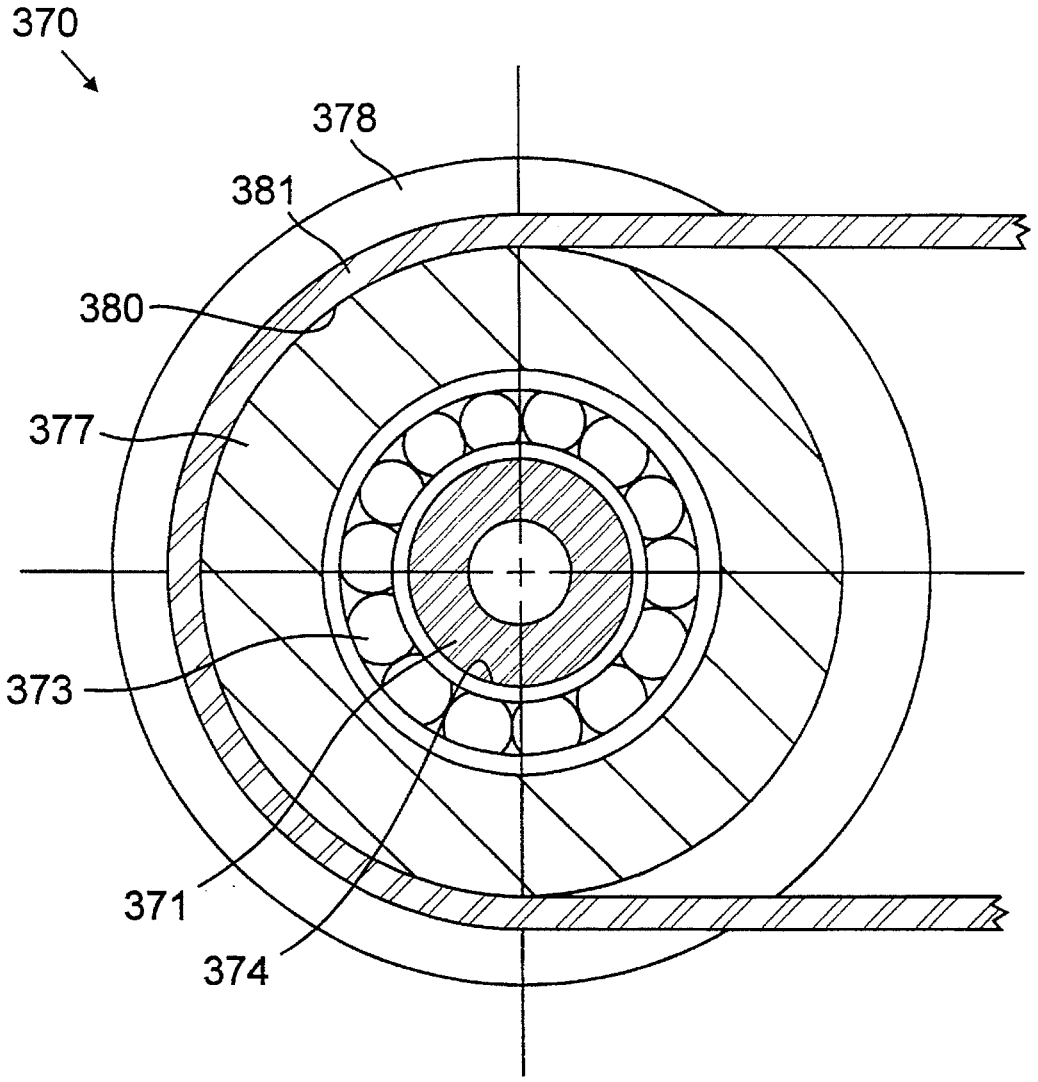
FIG. 6 is a cross sectional view taken through the self-aligning pulley of FIG. 5 at section VI—$VI_1$.

FIG. 6 is a cross sectional view of the pulley 370 of FIG. 5, taken through section VI—$VI_1$. The self-aligning pulley 370 has a hub 377 mounted to a bearing 373. As shown in FIG. 5, a channel 378 having side walls 379 and a bottom 380 is disposed at the circumference of the hub 377 and adapted to accept a belt, such as the belt 381. In use, the belt 381 should lie flat against the bottom of the channel 378. These elements are conventional.

In the self-aligning pulley 370 of FIG. 5, a shaft 371 having a novel design is mounted to the frame 372. The shaft 371 is preferably made from a mild tool steel such as SAE 1018. The bearing 373 is mounted over the shaft 371 such that it is disposed symmetrically about the center of the shaft 371. The center of the shaft 371 has a crowned portion 374 that presents a convex surface to the bearings 373. Spacers or locking rings 375 are disposed at the ends of the shaft 371 to prevent the bearings 373 from slipping off the shaft 371. Alternatively, the shaft 371 could be formed with integral flanges at each end. Wave washers 376, preferably made of hardened steel having some compressibility, are mounted to the shaft 371 and disposed between each spacer 375 and the bearings 373. The wave washers 376 bias the bearings 373 away from the spacers 375 and, thus, operate to urge the bearings 373 toward the center of the convex surface. Other centering devices, such as o-rings, could be substituted for the wave washers 376. While the self-aligning pulley 370 is shown in FIG. 5 mounted to a cylindrical portion of the frame 372, which is fitted to an internal diameter of the shaft 371, the frame 372 could alternatively have bores fitted to the external diameters of the spacers 375 and still practice the invention.

Figure 7:
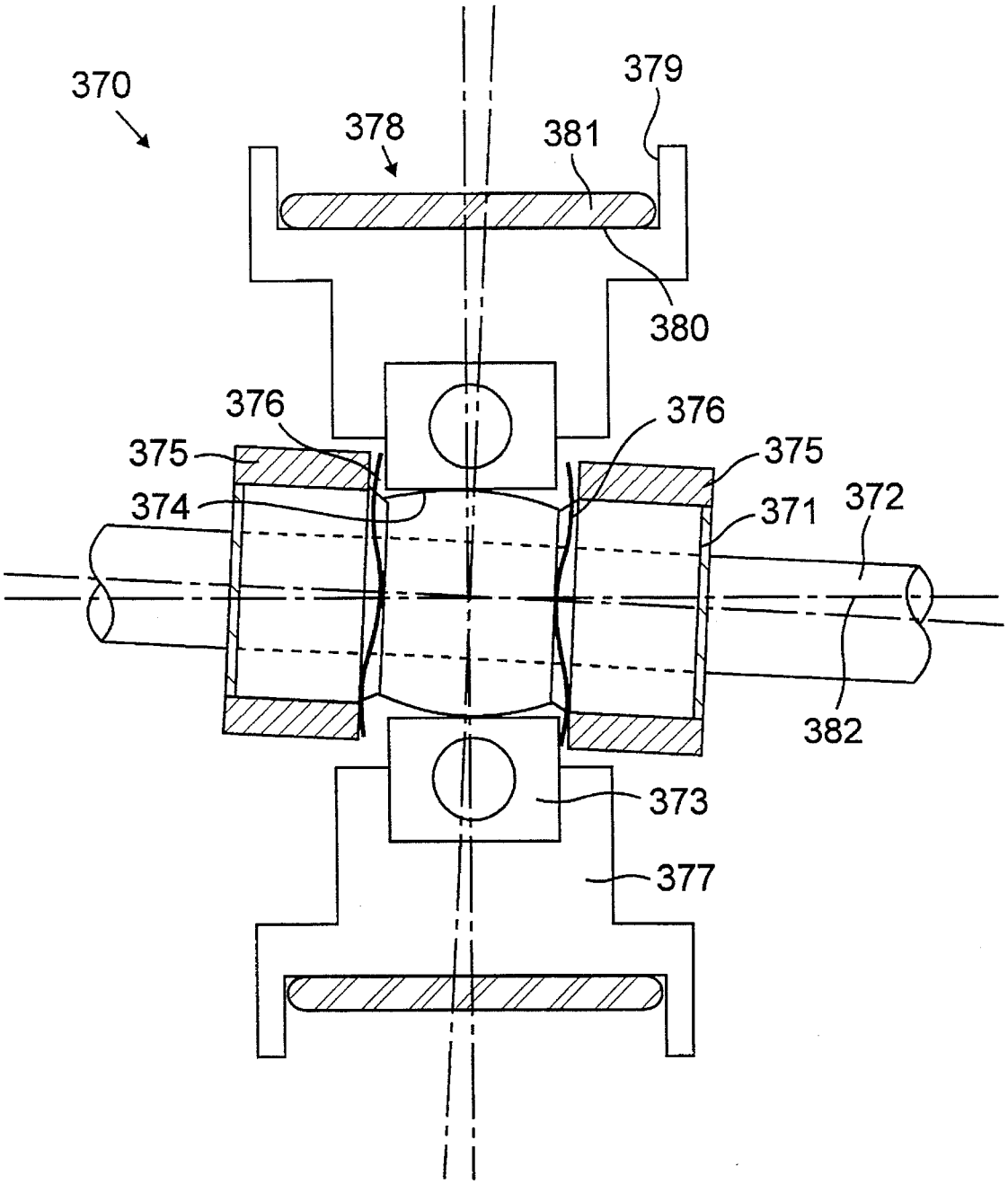
FIG. 7 is another cross sectional view of the self-aligning pulley of FIG. 5 correcting for misalignment.

FIG. 7 is a cross sectional view of the self-aligning pulley 370 shown correcting for a misalignment. As shown, the frame 372 is misaligned from a horizontal axis 382. However, this apparatus would work equally well if the belt 381 were misaligned. If a traditional pulley were used, the belt 381 would ride, at least in part, on the side wall 379 of the channel 378. When the misalignment is severe, or over long periods of use, the belt 381 would have a tendency to ride up over the side wall 379 completely, such that the belt 381 would be completely out of the channel 378. The self-aligning pulley 370, however, compensates for misalignment by tilting about a plane extending through the center of the pulley 370. When misaligned, the belt 381 exerts a force on the pulley 370 that overcomes the bias of the wave washers 376 and causes the bearings 373 to slide over the crowned portion 374, resulting in the tilting of the pulley 370. The tilting of the pulley 370 maintains the belt 381 in a flat position against the bottom 380 of the channel 378. The crowned portion 374, which is a surface of rotation, preferably maintains the pulley 370 in a symmetrical position with respect to the center of the shaft 371 so that the pulley 370 will tilt, rather than simply slide.

By compensating for belt misalignment, the self-aligning pulley 370 reduces maintenance costs by minimizing edge wear on the belt 381 and by reducing side loads on the bearing 373. Furthermore, the self-aligning pulley 370 can reduce manufacturing costs by permitting increased alignment tolerances without sacrificing belt life and smoothness of operation.

It is to be understood that the embodiments and variations shown and described above are illustrative of the principles of this invention only and that various modifications may be implemented by those skilled in the art without departing from the scope and spirit of the invention.

I claim:

1. An apparatus for performing a leg press with counterbalance comprising:

a frame;

a user support mounted to the frame;

a swing pivotally mounted to the frame distal to the user support;

a footplate mounted to the swing;

a first means for effecting a force on the swing operably engaged to the swing; and a second means for effecting a force on the swing such that the second effecting force counterbalances the force of gravity on the swing as the swing pivots, wherein said second force effecting means comprises:

an arm pivotally mounted to the frame;

a beam pivotally mounted to the arm and pivotally mounted to the swing; and a weight mounted to said arm.

2. The apparatus of claim 1, wherein said swing comprises:

a push bar pivotally connected to the frame;

a link pivotally connected to the frame proximate the push bar; and a mount pivotally connected to the push bar distal to the frame and pivotally connected to the link distal to the frame.

3. The apparatus of claim 1, wherein said first force effecting means comprises;

at least one weight plate operably engaged to said swing by a belt; and an adjustable length rod pivotally mounted to the swing and attached to said belt.

4. An apparatus for exercising muscles of a user at a selected resistance comprising:

a frame having a first end and a second end;

a swing mounted to the frame at the second end for pivotal movement, wherein a gravity force is exerted on the swing;

a footplate mounted to the swing distal to the frame;

an arm mounted to the frame at the first end for pivotal movement;

a weight mounted to the arm distal to the frame;

a means for resisting the pivoting of the swing selectively engagable to the swing such that the swing is in an exercise condition when the means is engaged and in an adjustment condition when the means is not engaged; and a beam pivotally mounted to the swing and pivotally mounted to the arm, wherein a counterbalance force is exerted on the swing by the beam, wherein the counterbalance force counteracts the gravity force such that a net force exerted on the swing is substantially zero when said selectively engagable resistance means is in said adjustment condition.

5. The apparatus of claim 4 wherein the resisting means comprises a weight stack.

6. The apparatus of claim 4 wherein the resisting means comprises an incremental weight stack.

7. The apparatus of claim 4 further comprising a user support mounted at the first end of the frame.

8. The apparatus of claim 4 wherein the swing comprises a four-bar linkage.

9. The apparatus of claim 4 wherein the resisting means is engaged to the swing by an adjustable length rod.

10. The apparatus of claim 4 wherein the frame comprises a frame extension bar and wherein the arm is pivotally mounted to the frame extension bar.

11. The apparatus of claim 10 wherein the arm extends down from the frame extension bar.

12. The apparatus of claim 4 wherein the resisting means is engaged to the swing by a belt.

13. The apparatus of claim 12 further comprising a self-aligning pulley mounted to the frame wherein the belt extends over the self-aligning pulley.

14. A leg press apparatus with counterweight comprising:

a frame having a first end and a second end;

a user support mounted to the frame at the first end;

a push bar pivotally connected to the frame at the second end;

a link pivotally connected to the frame at the second end proximate to the push bar;

a mount pivotally connected to the push bar distal to the frame and pivotally connected to the link distal to the frame;

a footplate mounted to the mount, wherein a gravity force is exerted on the footplate;

an arm pivotally mounted to the frame near the first end;

a weight mounted to the arm distal to the frame; and a beam pivotally mounted to the push bar and the arm, wherein a counterbalance force is exerted on the footplate by the beam, wherein the counterbalance force substantially counteracts the gravity force over a full range of motion of said footplate.

15. The apparatus of claim 1 further comprising a force providing means operably engaged to the push bar.

16. The apparatus of claim 15 wherein the force providing means comprises at least a first weight plate engaged to the push bar by a belt.

17. The apparatus of claim 16, further comprising a self-aligning pulley mounted to the frame wherein the belt extends over the self-aligning pulley.

18. The apparatus of claim 17 further comprising a rod pivotally mounted to the push bar and attached to the belt.

19. The apparatus of claim 18 wherein the rod has an adjustable length.

20. The apparatus of claim 19 wherein the rod comprises two telescoping portions selectably engaged by a pin/detent connection.

21. The apparatus of claim 15 wherein the force providing means includes an incremental weight stack attached to the frame.

22. The apparatus of claim 1 wherein the user support comprises a backrest rotatably mounted to the frame and further comprising a support mounted to the backrest and a means for engaging the support to the frame at various positions along the support.

23. A method for exercising the legs and lower torso of a user on a machine having a frame, a user support, a swing pivotally mounted to the frame, a footplate mounted to the swing, an arm pivotally mounted to the frame, a counterbalance weight attached to the arm, a beam pivotally mounted to the arm and to the swing, and a weight stack operably engaged to the swing, the method comprising the steps of:

positioning the user on the user support;

selecting a weight resistance for exercise;

positioning feet of the user on the footplate; and displacing the footplate by exerting at least sufficient force to overcome the weight resistance, such that the swing is caused to pivot an amount and the counterbalance is displaced.

24. The method of claim 23 wherein the swing is engaged to the weight stack by an adjustable length rod further comprising the step of adjusting the length of the rod.

25. The method of claim 23 further comprising the step of rotating a backrest of the user support to a comfortable position.

* * * * *